US006684827B1

(12) United States Patent
Sudmanns

(10) Patent No.: US 6,684,827 B1
(45) Date of Patent: Feb. 3, 2004

(54) LIQUID COOLED INTERNAL COMBUSTION ENGINE

(75) Inventor: Hans Sudmanns, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 60 days.

(21) Appl. No.: 10/019,559

(22) PCT Filed: Jun. 27, 2000

(86) PCT No.: PCT/EP00/05975

§ 371 (c)(1),
(2), (4) Date: Apr. 26, 2002

(87) PCT Pub. No.: WO01/02706

PCT Pub. Date: Jan. 11, 2001

(30) Foreign Application Priority Data

Jun. 30, 1999 (DE) ..... 199 30 206

(51) Int. Cl.[7] ..... F01P 11/04; F01P 3/00

(52) U.S. Cl. ..... 123/41.29; 123/41.33; 123/196 AB

(58) Field of Search ..... 123/41.28, 41.29, 123/41.25, 41.31, 41.51, 41.33, 196 AB

(56) References Cited

U.S. PATENT DOCUMENTS 1,571,108 A * 1/1926 Diamant ..... 123/41.29
2,597,512 A * 5/1952 Montabone ..... 123/41.28
2,960,974 A * 11/1960 Olsen et al. ..... 123/41.08
4,084,564 A * 4/1978 Rickert ..... 123/514
4,423,708 A * 1/1984 Sweetland ..... 123/196 AB
4,929,038 A 5/1990 Reinartz et al.
5,515,817 A * 5/1996 Nurmi et al. ..... 123/41.29
5,606,937 A * 3/1997 Calhoun ..... 123/41.28
5,810,071 A * 9/1998 Pavlin ..... 165/284
6,125,799 A * 10/2000 Van Son et al. ..... 123/41.31

FOREIGN PATENT DOCUMENTS

| | | |
|---|---|---|
| CH | 543008 | 11/1973 |
| EP | 0675269 A1 | 10/1995 |
| FR | 908 144 | 4/1946 |

* cited by examiner

*Primary Examiner*—Henry C. Yuen
*Assistant Examiner*—Arnold Castro
(74) *Attorney, Agent, or Firm*—Crowell & Moring LLP

(57) ABSTRACT

Disclosed is a liquid cooled internal combustion engine, comprising a plurality of cooling circuits and one or several liquid radiators connected thereto. In order to produce one of several possible configurations of cooling circuits and liquid radiators, a cooling liquid guide housing comprising a plurality of first flow sections associated with the cooling circuits, a distributor housing comprising a plurality of second flow sections which are connected to the liquid radiators, and an intermediate element arranged between the liquid guide housing and the distributor housing are provided. The intermediate element has a specific arrangement of open passage sections between the first flow sections of the cooling liquid guide housing and the second flow sections of the distributor housing, corresponding to one of several possible configurations of cooling circuits and liquid radiators.

20 Claims, 2 Drawing Sheets

LIQUID COOLED INTERNAL COMBUSTION ENGINE

BACKGROUND AND SUMMARY OF THE INVENTION

Figure 1B:
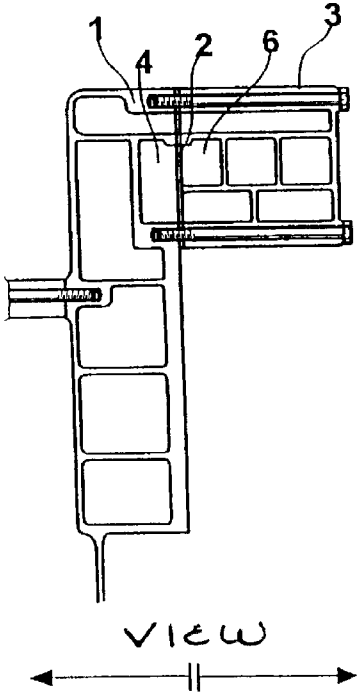

The invention relates to a liquid-cooled, particularly water-cooled internal-combustion engine, particularly to a water-cooled diesel engine, having a number of a number of cooling ducts, which are constructed in the internal-combustion engine and are assigned to different cooling circuits of the internal-combustion engine which carry a cooling liquid, and having one or several liquid radiators for cooling the cooling liquid carried in the cooling circuits.

In the case of higher-capacity liquid-cooled internal-combustion engines, for example, in the case of large-volume diesel engines for a steady-state use or a use in landcraft or seacraft, a number of cooling ducts, which are constructed in the internal-combustion engine and are assigned to different cooling circuits of the internal-combustion engine which carry a cooling liquid, are provided for cooling the internal-combustion engine and its auxiliary assemblies, such as charge air coolers or similar assemblies, and one or several liquid radiators are provided for cooling the cooling liquid carried in the cooling circuits.

According to the purpose of the internal-combustion engine and optionally as a function of different possible power stages of the same basic engine, it is desirable that the cooling circuits of the internal-combustion engine be configured in different fashions with one or several liquid radiators. For this purpose, it is either necessary to machine parts of the housing of the internal-combustion engine in different manners corresponding to different cooling circuit configuration or to supply different additional flow-guiding housings for the cooling liquid for an optional mounting on the internal-combustion engine. This results in high expenditures for the manufacture of the internal-combustion engine and for the storage.

It is an object of the invention to provide an internal-combustion engine in which cooling circuits and liquid radiators can be configured differently in a simple manner.

This object is achieved according to certain preferred embodiments of the invention by providing a liquid-cooled, particularly water-cooled internal-combustion engine, particularly a water- cooled diesel engine, having a number of a number of cooling ducts, which are constructed in the internal-combustion engine and are assigned to different cooling circuits of the internal-combustion engine which carry a cooling liquid, and having one or several liquid radiators for cooling the cooling liquid carried in the cooling circuits, characterized by a cooling-liquid guide housing having a number of first flow cross-sections connected with the cooling ducts constructed in the internal-combustion engine and assigned to the various cooling-liquid circuits, and having a distributor housing having a number of second flow cross-sections connected with the liquid radiator or radiators, the first flow cross-sections and the second flow cross-sections being constructed on mutually corresponding surfaces of the cooling-liquid guide housing and of the distributor housing respectively and being assigned to one another in the sense of establishing different possible flow connections between the cooling circuits of the internal-combustion engine and the liquid radiator or radiators, and by an intermediate element arranged between the cooling-liquid guide housing and the distributor housing, which intermediate element has open passage cross-sections establishing a number of flow connections corresponding to a certain configuration of several possible configurations of the cooling circuits of the internal-combustion engine and to one or several liquid radiators, between the first flow cross-sections constructed in the cooling-liquid guide housing and the second flow cross-sections constructed in the distributor housing, and blocks other possible flow connections between the first and the second flow cross-sections, the intermediate element being is selected from a number of intermediate elements which have different arrangements of open passage cross-sections corresponding to different possible configurations of the cooling circuits and the liquid radiators, and which intermediate elements can be exchanged for one another.

Further developments of the invention are described herein and in the claims.

As a result of the invention, a liquid-cooled, particularly water-cooled internal-combustion engine, particularly a water-cooled diesel engine, is created in the case of which a number of cooling ducts, which are constructed in the internal-combustion engine and are assigned to different cooling circuits of the internal-combustion engine which carry a cooling liquid, are provided, and one or several liquid radiators are provided for cooling the cooling liquid carried in the cooling circuits. According to the invention, the internal-combustion engine has a cooling-liquid housing, which has a number of first flow cross-sections which are connected with the cooling ducts constructed in the internal-combustion engine and are assigned to the different cooling circuits, and a distributor housing, which has a number of second flow cross-sections connected with the liquid radiators or radiator. In this case, the first flow cross-sections constructed in the cooling-liquid guide housing and the second flow cross-sections constructed in the distributor housing are constructed on mutually corresponding surfaces of the cooling-liquid guide housing or of the distributor housing and are assigned to one another in the sense of establishing various possible flow connections between the cooling circuits of the internal-combustion engine and the liquid radiator or radiators. Furthermore, an intermediate element is provided which is arranged between the cooling-liquid guide housing and the distributor housing, which intermediate element has open passage cross-sections establishing a number of flow connections corresponding to a certain configuration of several possible configurations of the cooling circuits of the internal-combustion engine and to one or several liquid radiators between the first flow cross-sections constructed in the cooling-liquid guide housing and the second flow cross-sections constructed in the distributor housing, and blocks other possible flow connections between the first and the second flow cross-sections. This intermediate element is selected from a number of intermediate elements which have different arrangements of open passage cross-sections corresponding to different possible configurations of the cooling circuits and the liquid radiators, and which intermediate elements can be exchanged for one another.

An important advantage of the internal-combustion engine according to the invention is the fact that, by means of only a few components, several different configurations of cooling circuits and liquid radiators can be implemented. Another advantage is the fact that, also in the case of an already installed internal-combustion engine, in the event of a power increase or modification, one cooling-circuit configuration can be replaced by another.

According to a preferred embodiment of the invention, it is provided that the mutually corresponding surfaces of the cooling-liquid guide housing and of the distributor housing respectively are plane surfaces, and that the intermediate element is constructed as a plane-parallel element and is arranged between the plane surfaces of the cooling-liquid guide housing and of the distributor housing.

The latter is preferably further developed such that the mutually corresponding plane surfaces of the cooling-liquid guide housing and of the distributor housing respectively have the same shape and size, that the mutually assigned first flow cross-sections constructed in the cooling-liquid guide housing and second flow cross-sections constructed in the distributor housing are arranged opposite one another in the mutually corresponding plane surfaces of the cooling-liquid guide housing and of the distributor housing respectively, and that the intermediate element is constructed as a plane-parallel plate with recesses forming the open passage cross-sections, the recesses each exposing flow connections between mutually opposite flow cross-sections of the cooling-liquid guide housing and of the distributor housing. The advantage is the simple and cost-effective producibility of the intermediate element as a plane-parallel plate and a small space requirement of the thus created arrangement.

According to a preferred embodiment, the mutually corresponding plane surfaces of the cooling-liquid guide housing and of the distributor housing respectively have an essentially rectangular basic shape, this rectangular basic shape in each case containing the first flow cross-sections constructed in the cooling-liquid guide housing and the second flow cross-sections constructed in the distributor housing respectively.

Preferably, the first flow cross-sections constructed in the cooling-liquid guide housing and the second flow cross-sections constructed in the distributor housing each form a matrix-type arrangement of flow cross-sections of a smaller rectangular basic shape or of flow cross-sections composed of rectangular basic shapes.

According to a preferred further development of the invention, the recesses constructed in the intermediate element, in the sense of influencing the passage cross-section between the first flow cross-sections constructed in the cooling-liquid guide housing and the second flow cross-sections constructed in the distributor housing, have the same or a smaller cross-section than the first and second flow cross-sections respectively.

According to an embodiment thereof, the recesses of the intermediate element have the same shape and size as the first or second flow cross-sections respectively.

According to an alternative embodiment, the recesses of the intermediate element are smaller than the first and second flow cross-sections respectively and have a rectangular or a circular cross-section.

In the following, an embodiment of the invention will be explained by means of the drawing.

DETAILED DESCRIPTION OF THE DRAWINGS

Figure 1A:
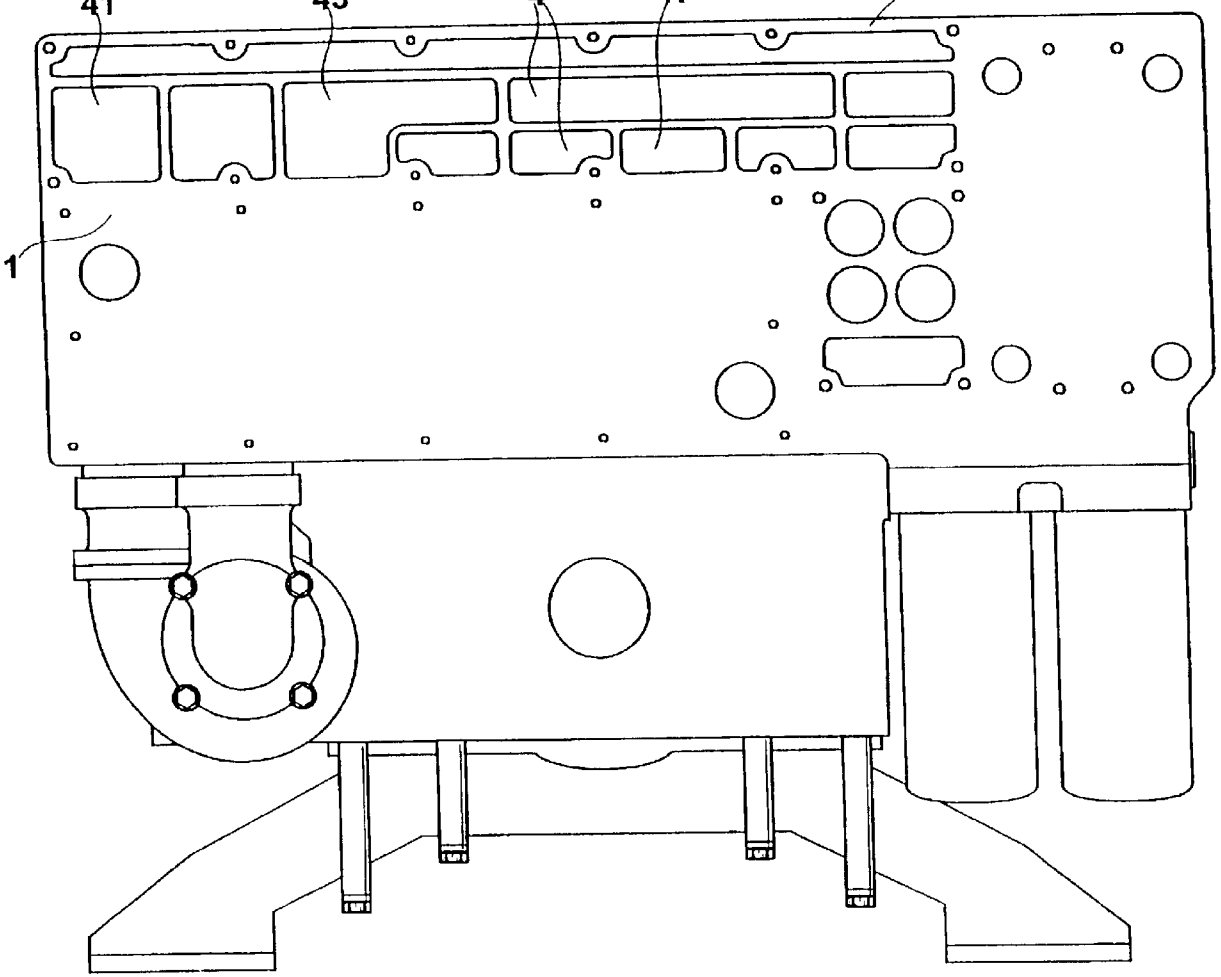

FIG. 1*a* is a top view of a cooling liquid guide housing, an intermediate element and a part of an internal-combustion containing a distributor housing, constructed according to an embodiment of the invention;

FIG. 1*b* is a part sectional view of the arrangement of FIG. 1*a;*

Figure 2A:
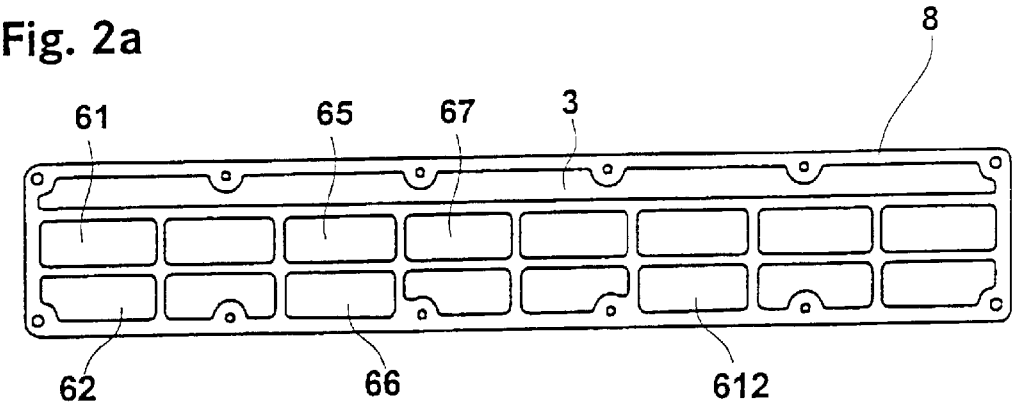
Figure 2B:
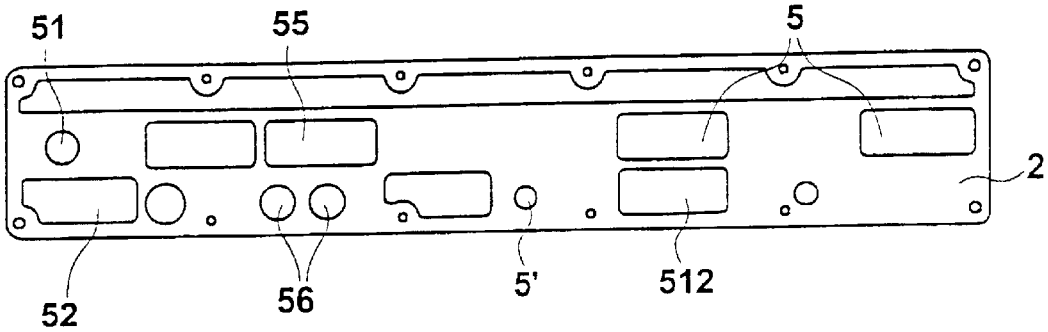
Figure 2C:
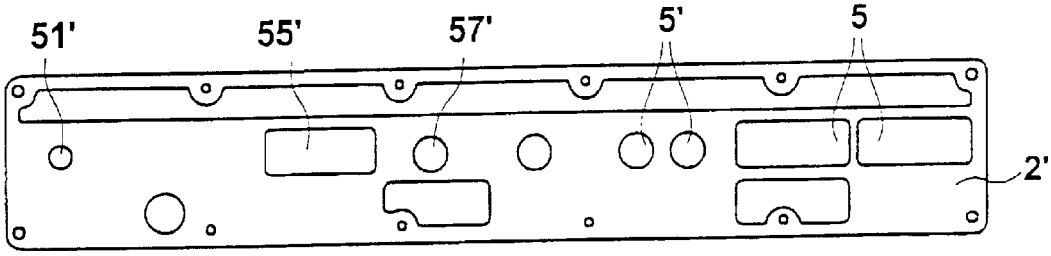
Figure 2D:
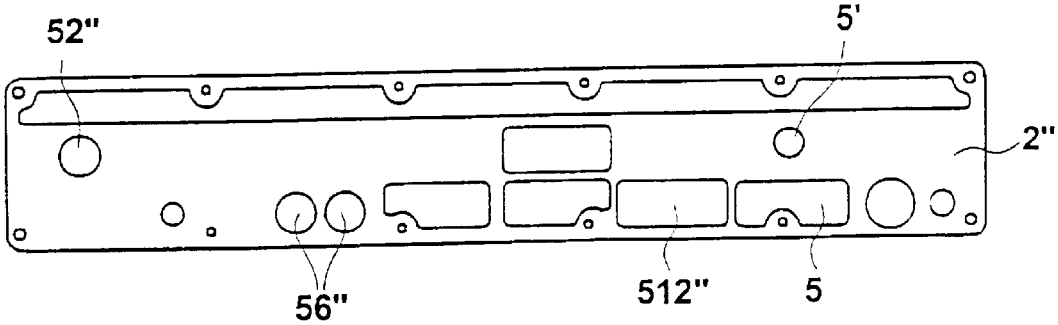

FIG. 2*a* is a view of the distributor housing of FIG. 1*b*, taken in viewing direction B;

FIG. 2*b* is a view of the intermediate element of FIG. 1*b*, taken in a viewing direction A, showing a first embodiment of the intermediate element;

FIG. 2C is a view similar to FIG. 2*b*, showing a second emdodiment of the intermediate element; and FIG. 2*d* is a view similar to FIG. 2*b*, showing a third embodiment of the intermediate element.

FIGS. 1*a* and 1*b* are a view and a cross-section respectively of a cooling-liquid guide housing 1 and of a distributor housing respectively 3 as components of a liquid-cooled internal-combustion engine, particularly of a water-cooled diesel engine. As illustrated in FIG. 1*a* by broken lines, a number of different cooling ducts are constructed in the internal-combustion engine which are assigned to cooling circuits carrying a cooling liquid. Furthermore, one or several liquid radiators are provided for the internal-combustion engine for cooling the cooling liquid carried in the cooling circuits, which, however, are not illustrated in the figure.

The cooling-liquid guide housing 1 has a number of first flow cross-sections 4, which are illustrated in FIGS. 1*a* and 1*b* and which are connected with the cooling ducts which are constructed in the internal-combustion engine and are assigned to the different cooling circuits.

As illustrated in FIG. 1*b* and in FIG. 2*a*, which is a view of the distributor housing 3 in the viewing direction marked B in FIG. 1*b*, the distributor housing 3 has a number of second flow cross-sections 6 which are connected with the liquid radiator or radiators.

As illustrated by a combined view of FIGS. 1*a* and 2*a*, the first flow cross-sections 4 and the second flow cross-sections. 6 are constructed on mutually corresponding surfaces 7, 8 of the cooling-liquid guide housing 1 and of the distributor housing 3 respectively. The first flow cross-sections constructed in the cooling-liquid guide housing 1 and the second flow cross-sections 6 constructed in the distributor housing 3 are in each case arranged and assigned to one another such that the establishing of different possible flow connections can take place between the cooling circuits of the internal-combustion engine and the liquid radiator or radiators.

Furthermore, an intermediate element 2 is provided which is arranged between the cooling-liquid guide housing 1 and the distributor housing 3 and which is illustrated as a cross-sectional view in FIG. 1*b* and as a view in FIGS. 2*b* to 2*d*. The intermediate element 2 has a number of open passage cross-sections 5, 5' establishing flow connections between the first flow cross-sections 4 constructed in the cooling-liquid guide housing 1 and the second flow cross-sections constructed in the distributor housing 3. The flow connections established by the open passage cross-sections correspond to a certain configuration of several possible configurations of the cooling circuits of the internal-combustion engine and to the one or the several liquid radiators. Other possible flow connections between the first and the second flow cross-sections 4, 6 in the cooling liquid guide housing 1 and in the distributor housing 3 respectively are blocked by the intermediate element 2.

As illustrated by FIGS. 2*b* to 2*d*, the intermediate element 2 is one of a number of different intermediate elements 2 which have different arrangements of open passage cross-sections 5, 5' which correspond to various possible configurations of the cooling circuits and of liquid radiators and can be mutually exchanged. Thus, for example, in the case of an internal-combustion engine with a liquid-cooled charge air cooler, the intermediate element 2 illustrated in FIG. 2*b* may correspond to a configuration in which the cooling circuit of the charge air cooler is integrated in the engine cooling circuit; the intermediate cooling element 2' illustrated in FIG. 2*c* may correspond to a configuration in which the cooling liquid of the charge air cooler and the cooling liquid of the engine cooling circuit can be mixed; and the intermediate element 2" illustrated in FIG. 2*d* may correspond to a configuration in which the engine cooling circuit and the charge air cooling circuit are hermetically separated.

As illustrated by a combined view of FIG. 1*a* in conjunction with FIG. 1*b*, the mutually corresponding surfaces 7, 8 of the cooling-liquid guide housing 1 and of the distributor housing 3 are each plane surfaces, and the intermediate element 2 is constructed as a plane-parallel element which is arranged between the plane surfaces 7, 8 of the cooling-liquid guide housing 1 and of the distributor housing 3. The mutually corresponding plane surfaces 7, 8 of the cooling-liquid guide housing 1 and of the distributor housing 3 respectively have the same shape and size, and the first flow cross-sections 4 and second flow cross-sections 6 assigned to one another in the cooling-liquid guide housing 1 and in the distributor housing 3 respectively are arranged in a mutually opposite manner in these surfaces 7, 8. The intermediate element 2 is provided as a plane-parallel plate with recesses forming the open passage cross-sections 5, the recesses 5 in each case exposing flow connections between mutually opposite flow cross-sections 4, 6 of the cooling-liquid guide housing 1 and of the distributor housing 3 respectively. As illustrated, the mutually corresponding plane surfaces 7, 8 of the cooling-liquid guide housing 1 and of the distributor housing 3 respectively have an essentially rectangular basic shape which contains the first flow cross-sections 4 and the second flow cross-sections 6 respectively.

As illustrated by the respective views of FIG. 1*a* and of FIG. 2*a*, the first flow cross-sections 4 provided in the cooling-liquid guide housing 1 and the second flow cross-sections 6 provided in the distributor housing 3 each form a matrix-type arrangement of flow cross-sections, which each have a smaller rectangular basic shape or a shape composed of rectangular basic shapes. Thus, the first flow cross-sections 4l and 47 illustrated in FIG. 1*a* and constructed in the cooling-liquid housing 1 have a rectangular basic shape, while the flow cross-section 43 has a shape composed of smaller rectangular basic shapes.

As illustrated by a comparison of the views in FIGS. 1*a* and 2*a*, the shape and the size of the first flow cross-sections 4 in the liquid guide housing 1 correspond either to the shape and the size of the second flow cross-sections 6 of the distributor housing 3; or a certain cross-section of a first flow cross-section 4 in the liquid guide housing 1 corresponds to several second flow cross-sections 6 in the distributor housing 3. Thus, for example, the shape, size and arrangement of the first flow cross-section 47 of the cooling-liquid guide housing 1 corresponds to the shape, size and arrangement of the second flow cross-section 61 of the distributor housing 3 (for reasons of simplicity, a mirror-invertedly non-reversed representation of the views in FIGS. 1*a* and 2 is used as the basis). In contrast, the first flow cross-section 4 in the cooling-liquid guide housing 1 corresponds in its shape, size and arrangement to the two second flow cross-sections 61 and 62 of the distributor housing 3. The first flow cross-section 42 of the cooling-liquid guide housing finally corresponds in its shape, size and arrangement to the second flow cross-sections 65, 66, 67 of the distributor housing 3, etc.

As illustrated in the views of the different intermediate elements 2, 2', 2" in FIGS. 2*b* to 2*d* in conjunction with the views of the cooling-liquid guide housing 1 and of the distributor housing 3 in FIG. 1*a* and FIG. 2*a* respectively, the first flow cross-sections 4 and the second flow cross-sections 6 in the cooling-liquid guide housing and in the distributor housing 3 respectively are connected in different manners with one another by the open passage cross-sections or recesses 5 of the intermediate element 2. Thus, the recess 512 of the intermediate element 2 (FIG. 2*b*) and the recess 512" of the intermediate element 2" (FIG. 2*d*) connects the first flow cross-section 47 of the cooling-liquid guide housing 1 with the second flow cross-section 612 of the distributor housing 3, while these two flow cross-sections 47 and 612 are separated from one another by the intermediate element 2' illustrated in FIG. 2*c*. The first flow cross-section 43 of the cooling-liquid guide housing 1 is connected by the intermediate element 2 illustrated in FIG. 2*b* by way of the recess 55 with the second flow cross-section 65 and by the recesses 56 with the second flow cross-section 66 of the distributor housing 3. By means of the intermediate element 2' illustrated in FIG. 2*c*, the first flow cross-section 43 of the cooling-liquid guide housing 1 is connected by way of the recess 55' with the second flow cross-section 65 and by way of the recess 57' with the second flow cross-section 67 of the distributor housing 3. By means of the intermediate element 2" illustrated in FIG. 2*d*, the first flow cross-section 43 is connected by way of the recesses 56" only with the second flow cross-section 66 of the distributor housing 3. Thus, by means of the recesses or open passage cross-sections 5 of the intermediate element 2, the first flow cross-sections 4 of the cooling-liquid guide housing 1 and the second flow cross-sections 6 are optionally connected with one another and separated from one another in a coded manner, so that different configurations of circuits can be implemented between the cooling ducts of the cooling circuits of the internal-combustion engine and the liquid radiator or radiators.

The recesses 5 provided in the intermediate element 2, in the sense of influencing the passage cross-section between the first flow cross-sections 4 constructed in the cooling-liquid guide housing 1 and the second flow cross-sections 6 constructed in the distributor housing 3, may have the same cross-section as or a smaller cross-section than the first and second flow cross-sections 4, 6 respectively. That is, the recesses 5 of the intermediate element 2 may have the same shape and size as the first and second flow cross-sections 4, 6 respectively, or, in the case of a transition from a larger to a smaller flow cross-section, may have the same shape and size as the smaller one of the latter. Then the passage cross-section will be as large as possible and the flow resistance will therefore be minimal. On the other hand, the recesses 5 of the intermediate element may be smaller than the first and the second flow cross-sections 4, 6 respectively, or, in the case of a transition from a larger flow cross-section to a smaller flow cross-section, may be smaller than the smaller flow cross-section, so that a larger flow resistance is achieved. The recesses 5 may have a rectangular or a circular cross-section. Particularly in the case of small passage cross-sections, circular cross-sections are suitable as indicated by reference number 5' in FIGS. 2*b* to 2*d*.

What is claimed is:

1. liquid-cooled, particularly water-cooled internal-combustion engine, particularly a water-cooled diesel engine, having a number of a number of cooling ducts, which are constructed in the internal-combustion engine and are assigned to different cooling circuits of the internal-combustion engine which carry a cooling liquid, and having one or several liquid radiators for cooling the cooling liquid carried in the cooling circuits, characterized by a cooling-liquid guide housing having a number of first flow cross-sections connected with the cooling ducts constructed in the internal-combustion engine and assigned to the various cooling-liquid circuits, and having a distributor housing having a number of second flow cross-sections connected with the liquid radiator or radiators, the first flow cross-sections and the second flow cross-sections being constructed on mutually corresponding surfaces of the cooling-liquid guide housing and of the distributor housing respectively and being assigned to one another in the sense of establishing different possible flow connections between the cooling circuits of the internal-combustion engine and the liquid radiator or radiators, and by an intermediate element arranged between the cooling-liquid guide housing and the distributor housing, which intermediate element has open passage cross-sections establishing a number of flow connections corresponding to a certain configuration of several possible configurations of the cooling circuits of the internal-combustion engine and to one or several liquid radiators, between the first flow cross-sections constructed in the cooling-liquid guide housing and the second flow cross-sections constructed in the distributor housing, and blocks other possible flow connections between the first and the second flow cross-sections, the intermediate element being is selected from a number of intermediate elements which have different arrangements of open passage cross-sections corresponding to different possible configurations of the cooling circuits and the liquid radiators, and which intermediate elements can be exchanged for one another.

2. Internal-combustion engine according to claim 1, characterized in that the mutually corresponding surfaces of the liquid guide housing 1 and of the distributor housing respectively are plane surfaces, and in that the intermediate element is constructed as a plane-parallel element and is arranged between the plane surfaces of the cooling-liquid guide housing and of the distributor housing.

3. Internal-combustion engine according to claim 2, characterized in that the mutually corresponding plane surfaces of the cooling-liquid guide housing and of the distributor housing respectively have the same shape and size, in that the mutually assigned first flow cross-sections constructed in the cooling-liquid guide housing and the second flow cross-sections constructed in the distributor housing are arranged in a mutually opposite manner in the mutually corresponding plane surfaces of the cooling-liquid guide housing and of the distributor housing respectively, and in that the intermediate element is constructed as a plane-parallel plate with recesses forming the free passage cross-sections, the recesses, in each case, exposing flow connections between mutually opposite flow cross-sections of the cooling-liquid guide housing and of the distributor housing respectively.

4. Internal-combustion engine according to claim 3, characterized in that the mutually corresponding plane surfaces of the cooling-liquid guide housing and of the distributor housing respectively have a rectangular basic shape which in each case contains the first flow cross-sections constructed in the cooling-liquid guide housing and the second flow cross-sections constructed in the distributor housing.

5. Internal-combustion engine according to claim 4, characterized in that the first flow cross-sections constructed in the liquid guide housing and the second flow cross-sections constructed in the distributor housing each form a matrix-type arrangement of flow cross-sections with a smaller rectangular basic shape or with flow cross-sections composed of rectangular basic shapes.

6. Internal-combustion engine according to claim 5, characterized in that the recesses constructed in the intermediate element, in the sense of influencing the passage cross-section between the first flow cross-sections constructed in the liquid guide housing and the second flow cross-sections constructed in the distributor housing, have the same cross-section as or a smaller cross-sectional than the first and second flow cross-sections respectively.

7. Internal-combustion engine according to claim 6, characterized in that the recesses of the intermediate element have the same shape and size as the first and second flow cross-sections respectively.

8. Internal-combustion engine according to claim 6, characterized in that the recesses of the intermediate element are smaller than the first and second flow cross-sections respectively and have a rectangular or a circular cross-section.

9. Internal-combustion engine according to claim 4, characterized in that the recesses constructed in the intermediate element, in the sense of influencing the passage cross-section between the first flow cross-sections constructed in the liquid guide housing and the second flow cross-sections constructed in the distributor housing, have the same cross-section as or a smaller cross-sectional than the first and second flow cross-sections respectively.

10. Internal-combustion engine according to claim 9, characterized in that the recesses of the intermediate element have the same shape and size as the first and second flow cross-sections respectively.

11. Internal-combustion engine according to claim 9, characterized in that the recesses of the intermediate element are smaller than the first and second flow cross-sections respectively and have a rectangular or a circular cross-section.

12. Internal-combustion engine according to claim 3, 4 or 5, characterized in that the recesses constructed in the intermediate element, in the sense of influencing the passage cross-section between the first flow cross-sections constructed in the liquid guide housing and the second flow cross-sections constructed in the distributor housing, have the same cross-section as or a smaller cross-sectional than the first and second flow cross-sections respectively.

13. Internal-combustion engine according to claim 12, characterized in that the recesses of the intermediate element have the same shape and size as the first and second flow cross-sections respectively.

14. Internal-combustion engine according to claim 12, characterized in that the recesses of the intermediate element are smaller than the first and second flow cross-sections respectively and have a rectangular or a circular cross-section.

15. A coolant distribution assembly for internal combustion engines, comprising:

a cooling liquid guide housing exhibiting a plurality of first coolant flow channels communicating in use with respective cooling circuits, said first coolant flow channels having respective first coolant channel openings at one side of the cooling liquid guide housing, a distributor housing exhibiting a plurality of second coolant flow channels communicating in use with respective heat exchangers said second coolant flow channels having respective second coolant channel openings at one side of the distributor housing, and a plurality of intermediate elements selectively disposable between the cooling liquid guide housing and the distributor housing, said intermediate elements including respective through openings operable to connect respective ones of the first coolant channel openings with respective different ones of the intermediate elements including different patterns of through openings, thereby facilitating connection of different ones of the respective first and second coolant channel openings by exchanging said intermediate elements.

16. A coolant distributor assembly according to claim 15, wherein said cooling liquid guide housing includes a planar surface at said one side having the first coolant channel openings, wherein said distributor housing includes a planar surface at said one side of the distributor housing having the second coolant channel openings, and wherein said intermediate elements have respective planar surfaces which in use mate with the respective planar surface of the cooling liquid guide housing and distributor housing.

17. A coolant distributor assembly according to claim 16, wherein all of said planar surfaces are parallel with one another.

18. A method of making coolant distribution assemblies for internal combustion engines comprising:

making a cooling liquid guide housing exhibiting a plurality of first coolant flow channels communicating in use with respective cooling circuits, said first coolant flow channels having respective first coolant channel openings at one side of the cooling liquid guide housing, making a distributor housing exhibiting a plurality of second coolant flow channels communicating in use with respective heat exchangers said second coolant flow channels having respective second coolant channel openings at one side of the distributor housing, and making a plurality of intermediate elements selectively disposable between the cooling liquid guide housing and the distributor housing, said intermediate elements including respective through openings operable to connect respective ones of the first coolant channel openings with respective different ones of the intermediate elements including different patterns of through openings, and selectively interchanging said intermediate elements to form coolant distribution assemblies with different configurations of connections between respective first and coolant channel openings.

19. A method according to claim 18, wherein said cooling liquid guide housing includes a planar surface at said one side having the first coolant channel openings, wherein said distributor housing includes a planar surface at said one side of the distributor housing having the second coolant channel openings, and wherein said intermediate elements have respective planar surfaces which in use mate with the respective planar surface of the cooling liquid guide housing and distributor housing.

20. A method according to claim 18, wherein all of said planar surfaces are parallel with one another.

* * * * *